US005738029A

United States Patent [19]

Porter et al.

[11] Patent Number: 5,738,029

[45] Date of Patent: Apr. 14, 1998

[54] METHOD AND APPARATUS FOR SEWING HANDLES ON SIDE PANELS ON A BOX SPRING

[75] Inventors: Michael R. Porter, Topsfield, Mass.; Steven Marcangelo, Derry, N.H.

[73] Assignee: Porter Sewing Machines, Inc., Beverly, Mass.

[21] Appl. No.: 621,427

[22] Filed: Mar. 21, 1996

[51] Int. Cl.[6] ..... D05B 21/00; D05B 3/12

[52] U.S. Cl. ..... 112/470.07; 112/2.1; 112/114; 112/475.08; 5/703

[58] Field of Search ..... 112/470.06, 470.07, 112/470.09, 104, 113, 114, 2.1, 10, 147, 152, 475.08, 470.33; 5/703, 704

[56] References Cited

U.S. PATENT DOCUMENTS 1,731,530 10/1929 Goldeen et al. ..... 5/703

5,052,316 10/1991 Sakakibara ..... 112/104 X 5,174,480 12/1992 Otokuni ..... 112/470.07 X 5,520,129 5/1996 Porter et al. ..... 112/470.07

*Primary Examiner*—Peter Nerbun

*Attorney, Agent, or Firm*—Wolf, Greenfield & Sacks P.C.

[57] ABSTRACT

A method and apparatus for sewing a cloth handle to the side panel of a mattress or box spring. The apparatus includes a modified X-Y programmable sewing machine which can sew both ends of a handle to the side panel in sequence without the necessity of removing the handle and side panel from the clamp and manually adjusting the position of the side panel. The apparatus also includes a folding jig, and a clamp with an upper lip to retain the handle in a desired position. The method includes the steps of folding the handle and placing it within the clamp on the sewing machine, and thereafter sequentially stitching each end of the handle to the side panel automatically without removing the handle from the clamp or without manual movement of the side panel.

5 Claims, 4 Drawing Sheets

METHOD AND APPARATUS FOR SEWING HANDLES ON SIDE PANELS ON A BOX SPRING

FIELD OF THE INVENTION

This invention relates generally to methods and apparatus for the manufacture of mattresses and box springs and more particularly to a method and apparatus for attaching handles to the side panels of such a box spring or mattress.

BACKGROUND OF THE INVENTION

Most conventional beds include both a mattress and a box spring. The box spring is placed below the mattress, and generally rests directly on slats disposed on the bed frame. The purpose of the box spring is to provide suitable support for the mattress and the person using the bed and to maximize the level of comfort. A box spring typically includes a relatively rigid inner construction formed of springs or the like mounted on a wooden support structure. This inner construction is surrounded by a fabric enclosure which includes a top panel, a bottom panel and a side panel that extends around the perimeter of the box spring. A mattress typically is formed of an inner construction, which includes springs or the like, and a mattress sack which surrounds the inner construction and includes top, bottom and side panels.

For ease of handling the box spring and mattress, handles typically are provided on the side panels of each. These handles typically include a length of suitably folded and reinforced fabric which is stitched to the side panel at each end to provide a gripping area in the middle. Preferably, two such handles are provided on each long side of the mattress or box spring.

Presently, the handles used on the side panels of the enclosure for a box spring are formed of a strip of fabric whose ends have been folded toward the center of the strip along a transverse fold. The folded ends of the fabric strip are then stitched onto the side panel of a box spring enclosure, one end at a time, using an X-Y programmable sewing machine. A similar process may be used for mattresses.

One type of sewing machine which can be used for such a purpose is a Mitsubishi PLK 0804 programmable X-Y sewing machine. This particular machine includes a workpiece holder which moves the product being sewn with respect to the stitching needle. The holder has a stitching range of motion of 8.0 centimeters in the X-axis direction, or in a direction parallel to the direction of elongation of the fabric strip, and a stitching range of motion of 4.0 centimeters in the Y-axis direction, or in a direction perpendicular to the X-axis direction. As a result, when an operator uses this Mitsubishi machine to attach the fabric handles, first one end of the handle must be stitched, and then the other end of the handle must be stitched in a separate operation. While each stitching operation is performed automatically, the operator must move the side panel manually to first place one end of the handle beneath the holder and then to place the other end of the handle beneath the holder. This double stitching operation permits some room for error, since one end of the handle could shift during the stitching operation on the other end, or the handle could unfold during the delay in stitching, or the operation could misalign the second end of the handle during the moving operation. Also, this dual operation adds a significant amount of time and labor cost to the stitching operation.

It is therefore an object of the present invention to decrease the stitching time and increase the accuracy with which the handles are attached to the side panels of a box spring enclosure or a mattress sack.

SUMMARY OF THE INVENTION

This and other objects are achieved in accordance with present invention in which a modified programmable X-Y sewing machine stitches both ends of the fabric handle to the side panel of a box spring or mattress in one sewing operation. The method of this invention includes the steps of folding toward the middle along transverse folds the ends of the fabric to be used for the handle, and thereafter loading the folded fabric into a workpiece holder which is precisely positioned on the side panel of the box spring or mattress. A controller is programmed to provide the desired stitches in sequence on one end of the handle, and thereafter to automatically move the workpiece holder to the second end of the handle for sewing of the desired stitches in sequence on that end of the handle. The desired handle stitch includes, in sequence, a stitch around the perimeter of the end portion of the handle, and, two diagonal stitches in the end portion of the handle. Thereafter, the workpiece holder automatically is raised to permit removal of the side panel from the sewing area.

A Mitsubishi PLK 0804 programmable X-Y sewing machine has been modified to provide the apparatus of this invention. The modifications include the provision of longer belts for movement of the workpiece holder and reworking and moving the idler pulley for the belts for the workpiece holder. The apparatus also includes a longer slide in the X-axis direction. The plate used to lower the workpiece is replaced by more efficient pneumatic cylinders. The logic has been modified to allow the workpiece to move a greater distance in the X-and Y-axis directions. Finally, a folding jig is provided on the table to assist the user in folding the fabric handles prior to stitching.

The method and apparatus of this invention decrease the required time and labor costs and increase the accuracy of the operations for stitching the fabric handle onto the side panels of a box spring or mattress sack.

BRIEF DESCRIPTION OF THE DRAWINGS

The invention will be more fully appreciated from the following detailed description when taken in conjunction with the accompanying drawings, in which.

DETAILED DESCRIPTION

Figure 1:
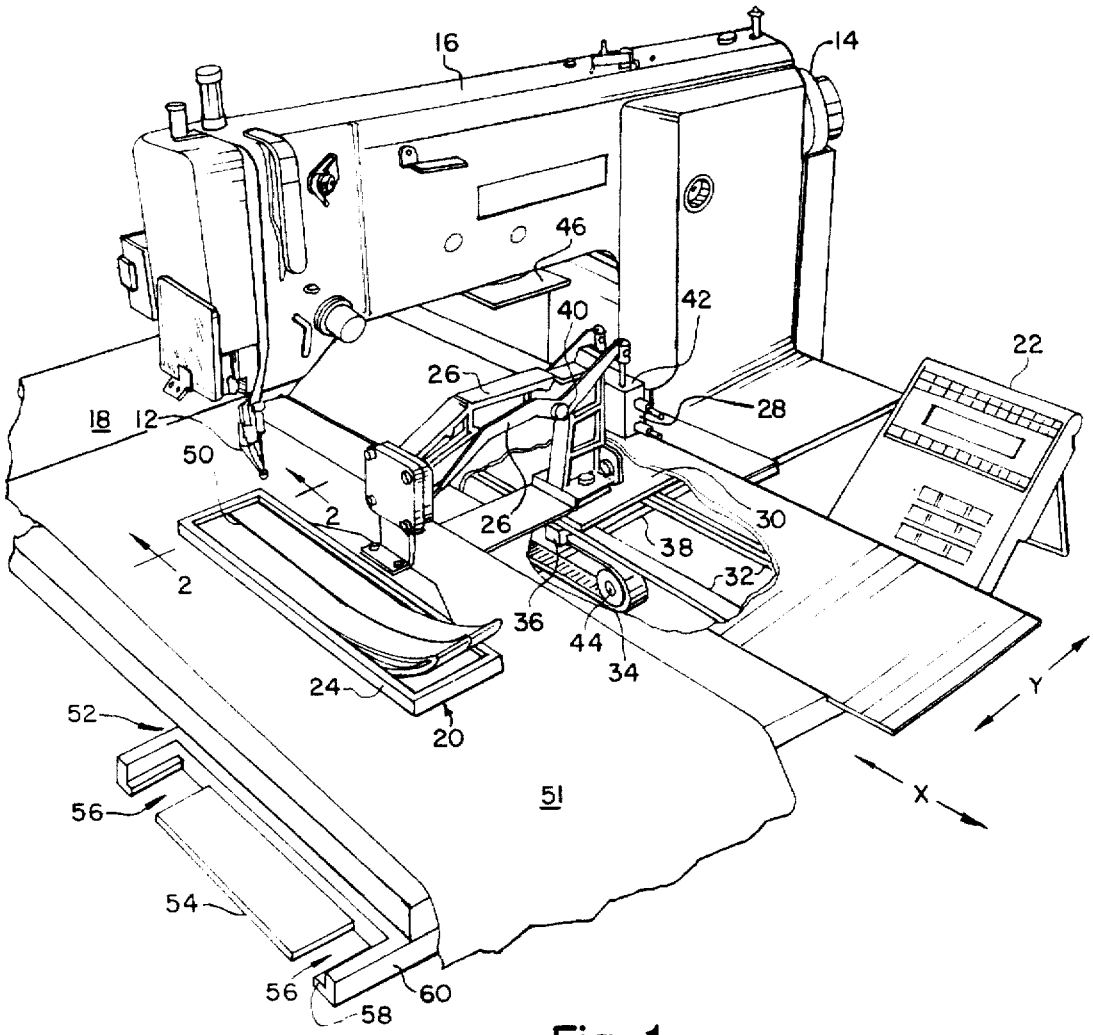
FIG. 1 is a partial, top perspective view illustrating the sewing apparatus of the present invention.

With reference now to the drawings, and more particularly to FIG. 1 thereof, the sewing apparatus of the present invention will now be described. Sewing machine 10 can be any programmable X-Y sewing machine which has been modified as set forth hereinbelow for practice of the present invention. In a preferred embodiment, machine 10 comprises a modified Mitsubishi PLK 0804 programmable X-Y sewing machine. Machine 10 includes a conventional sewing needle 12 which runs off the main drive shaft 14 within housing 16. A workpiece holder 20 moves along a table 18 in an X-axis direction, and in a Y-axis direction which is perpendicular to, but in the plane of the X-axis direction. The entire operation is controlled by controller 22. All of the foregoing elements are contained in the basic Mitsubishi PLK 0804 machine, although workpiece holder 20 has been modified as will be described hereinafter, and the logic in controller 22 has been modified in accordance with the present invention.

Workpiece holder 20 includes a clamp 24, two clamp arms 26, support 28 and a sled 30. Sled 30 rides on rails 32 and is moved back and forth in an X-axis direction, by belt 34 to which sled 30 is connected by connector 36. A second belt 38 which is disposed in a direction generally orthogonal to belt 34 is connected to sled 30 for movement of sled 30 in the Y-axis direction.

Arms 26 are pivotally mounted at point 40 near their center, or at some other point intermediate their ends, to support 28. A distal end of each arm 26 is coupled to clamp 24, while a proximal end of each arm on the other side of the pivot point 40 is coupled to a pneumatic cylinder 42. Actuation of cylinders 42 causes pivoting of arms 26 about pivot point 40, thus raising or lowering of clamp 24 with regard to table 18.

In an existing Mitsubishi PLK 0804 programmable X-Y sewing machine, the permissible sewing area, or the area in which clamp 24 is moved for programmable sewing is a rectangle having a dimension approximately 8.0 cm in the X-axis direction and 4.0 cm in the Y-axis direction. Thus, with a conventional Mitsubishi machine, an operator can only sew over a very small area. In this invention, the movement of clamp 24 is increased to 9¼ inches in the X-axis direction, and 2⅛ inches in the Y-axis direction. This increased range makes possible stitching of an entire handle to a side panel of a box spring or mattress in one operation without manually moving the material after stitching of a handle at each end thereof. This increased range was made possible by using a longer belt 34 than that originally provided, by moving the position of idler pulley 44 away from the driving pulley (not shown), or to the right in the X-axis direction as shown in FIG. 1. This increased range was also accomplished by extending the length of rails 32 and by providing a longer belt 38. Moreover, the logic was reworked using a commercially available logic package to permit the greater movement now demanded, and to permit programming of the Mitsubishi PLK controller 22 to move over greater distances than previously permitted. An enlarged clamp 24 also was provided to accommodate this larger range of movement. Clamp 24 now has an interior length in its direction of elongation and in the direction of elongation of the side panel equal to the length of the handle 50 and an interior width transverse to the direction of elongation equal to the width of handle 50.

Figure 2:
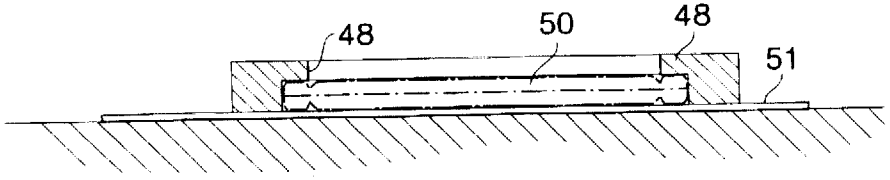
FIG. 2 is a cross-sectional end view of the work holder of this invention taken along the line 2—2 of FIG. 1.
Figure 3:
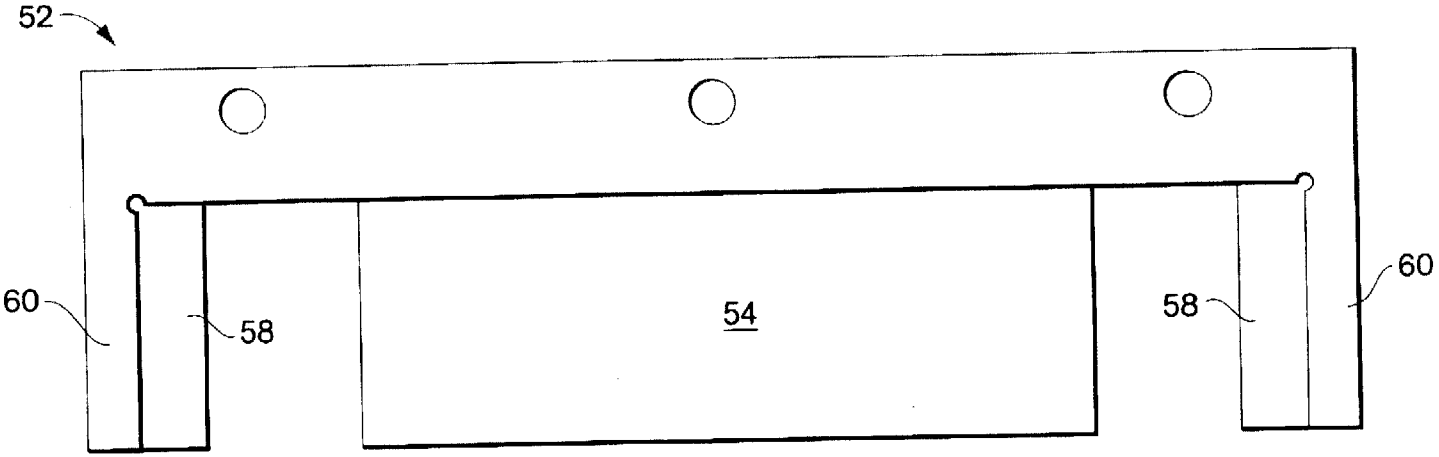
FIG. 3 is a top plan view of the folding jig of FIG. 1.

Another change that was made to the Mitsubishi PLK 0804 machine includes the provision of pneumatic cylinders 42 in place of plate 46 which previously had been used to drive arms 26 in a downwardly position to lower clamp 24. In this modification, plate 46 has been deactivated. As illustrated in FIG. 2, the clamp originally provided on the Mitsubishi PLK 0804 was further modified to include an upper lip 48 which is disposed on the upper edge of clamp 24 and which extends around the perimeter of clamp 24 and inwardly toward the center of clamp 24 for retention of a handle 50 within clamp 24 during the sewing process.

Another aspect of this invention includes a folding jig 52 disposed on table 18 at a convenient location for the operator. Folding jig 52 includes a centrally disposed plate 54 which has a length which is equal to the length of handle 50 in its stitched-on condition, and slots 56 disposed at either end of plate 54. Plate 54 may be removable to allow plates of different sizes to be inserted in jig 52 for handles of different lengths. Slots 56 should be sufficiently wide to allow the user to fold the material of handle 50 about plate 54 and to accommodate plates of different lengths. Slots 54 should be open on one side thereof to allow the operator to slide handle 50 off jig 52 once it is in its folded condition. Typically, jig 52 contains inwardly extending lips 58 disposed on opposed end supports 60. Lips 58 support the ends of handle 50 in its unfolded condition as will be described hereinafter with respect to the method of this invention. Typically, supports 60 are spaced from one another approximately the length of handle 50 in its unfolded condition, so that the ends of handle 50 in their unfolded condition rest on lips 58 within supports 60.

Figure 4:
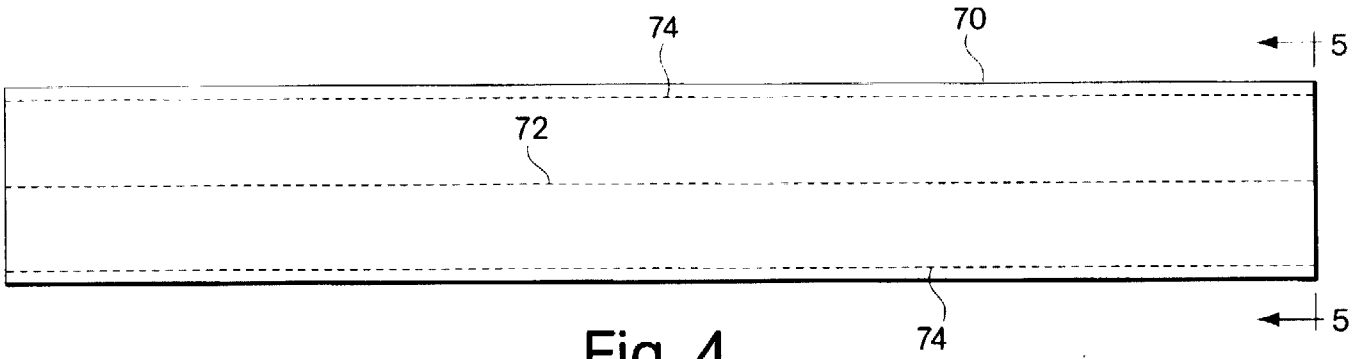
FIG. 4 is a top plan view of the handle material of the present invention.
Figure 5:
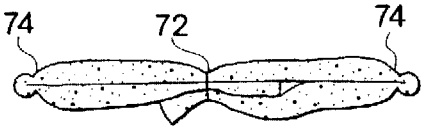
FIG. 5 is an end view of the handle material of FIG. 4 taken the along line 5—5 of FIG. 4.

The method of this invention will now be described with specific reference to FIGS. 1–9. The material which forms handle 50 is initially provided as a strip 70 of folded material as illustrated in FIGS. 4 and 5. Strip 70 typically has an indeterminate length and flaps 76 which have been folded laterally inwardly toward the middle along each longitudinal edge. This structure is illustrated in FIG. 5. Strip 70 is then stitched longitudinally at three locations, including a central stitch 72 and two edge stitches 74. Central stitch 72 holds the two flaps 76 together in a folded position as shown in FIG. 5. Strip 70 is then cut into segments of a predetermined length to form handles 50. The length of each segment is dependent upon the precise length of the handle 50 which is desired to be attached to a box spring or mattress.

Figure 6:
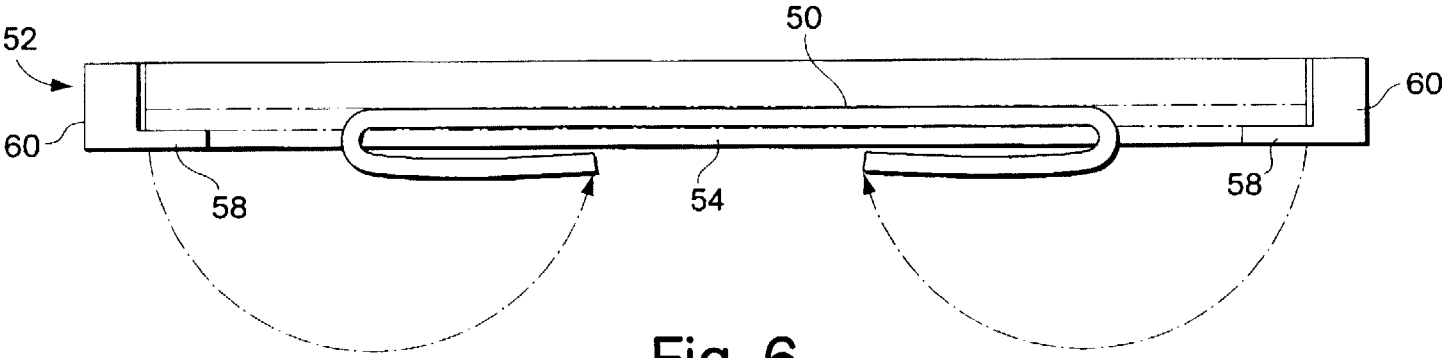
FIG. 6 is a front elevation view of the folding jig of FIG. 3 showing folding of the handle material of FIG. 4.

The next step is illustrated in FIG. 6. Handle 50 is placed into jig 52 as illustrated in phantom in FIG. 6. The ends of handle 50 rest on lips 58, while the center thereof rests on plate 54. Handle 50 is thus centered in jig 52, as the ends of handle 50 abut end supports 60. The operator then folds handle 50 about plate 54 as shown in FIG. 6 by pulling the ends of handle 50 downwardly through slots 56 and folding the ends of handle 50 along a transverse fold around toward the underside of plate 54. Handle 50 in its folded condition is then slid off plate 54 away from table 18.

Figure 7:
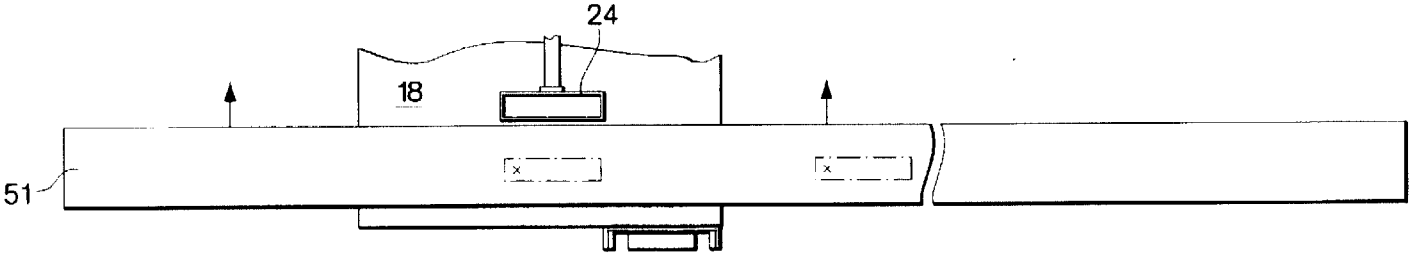
FIG. 7 is a top diagrammatic view illustrating the placement of the side panel in the sewing apparatus of FIG. 1.

As illustrated in FIG. 7, the location of each handle 50 has been previously marked on side panel 51 prior to placement of side panel 51 on table 18. In particular, typically, an "X" is placed where one end of the handle should be placed or mounted on side panel 51. Side panel 51 is slid laterally along table 18 toward sewing machine 10 as illustrated in FIG. 7 until the premarked portion is aligned directly beneath clamp 24. Clamp 24 is in its home position at this point, which typically is centered on sewing needle 12. Once panel 51 is in the desired position, clamp 24 is lowered by a foot pedal (not shown) or controller 22 into position on side panel 51 to hold side panel 51 securely on table 18. Clamp 24 is aligned so that it is elongated in the direction of elongation of panel 51. At this point, the operator then places handle 50 into clamp 24. Edges of handle 50 are pushed beneath lip 48 of clamp 24 so if that handle 50 is retained securely against side panel 51.

The sewing process is then initiated by stepping on a foot pedal (not shown), or in some other conventional manner.

Figure 8:
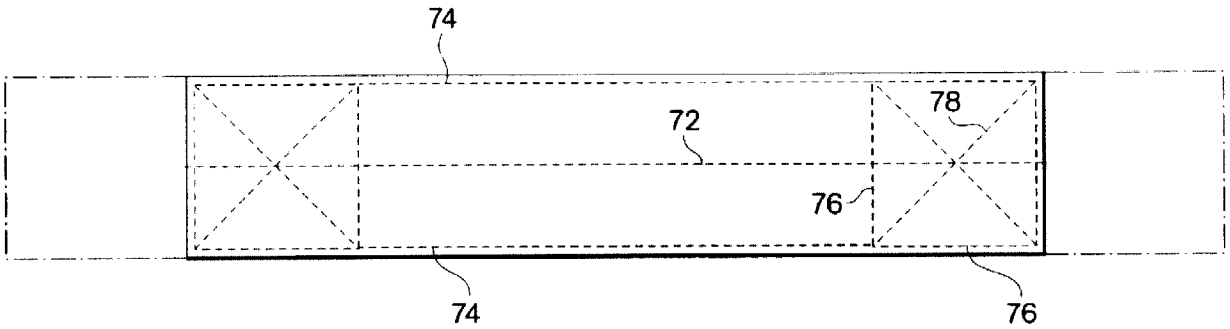
FIG. 8 is a top plan view of the material of FIG. 4 after being sewn to the side panel and formed into a handle.
Figure 9:
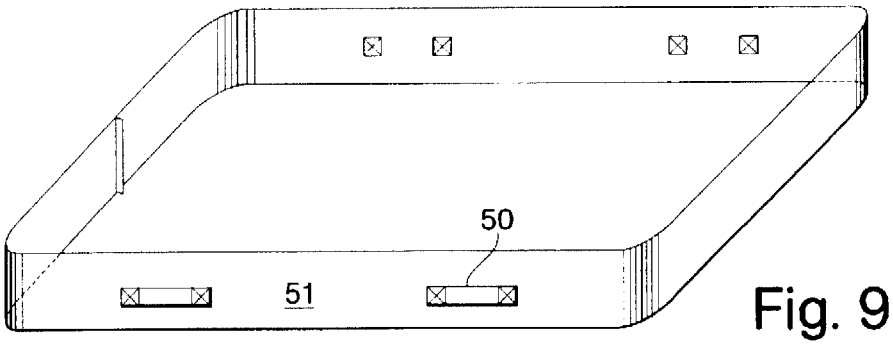
FIG. 9 is a top perspective view illustrating the placement of the handles of FIG. 8 on a side panel of a box spring or mattress.

Belts 34 and 38 are driven by a servo motor (not shown) and belts 34 and 38 in turn move sled 30 in a manner well known to those skilled in the art. Sled 30 positions clamp 24 with respect to needle 12. First, one end of handle 50 is stitched in accordance with a preprogrammed pattern, and then clamp 24 indexes with respect to needle 12 sufficiently far in the X-axis direction so that the other end is stitched. This process is all performed automatically, and controller 22 is programmed to provide the desired stitch. A typical stitch is shown in FIG. 8. Preferably, although not necessarily, a perimeter stitch 76 is first stitched, in a rectangle box or square configuration as shown in FIG. 8, by moving clamp 24 with respect to needle 12. Preferably, the stitch is begun in one corner of clamp 24. Thereafter, two diagonal stitches 78 are performed which extend diagonally across the stitch 76 from one corner of the rectangular to an opposite corner. When the diagonal stitches have been completed, the clamp 24 is indexed by controller 22 so that needle 12 is at the other end of clamp 24. Needle 12 then stitches the other end of handle 50 to side panel 51. The same stitching sequence is repeated for the other end of handle 50. Thereafter, the stitching operation automatically ceases and clamp 24 returns to its home position. When clamp 24 returns to its home position, it is automatically raised by cylinders 42 to free handle 50 and to permit side panel 51 to be manually advanced to the next location where a handle is to be sewn onto side panel 51.

In view of the above description, it is likely that modifications and improvements will occur to those skilled in the art which are within the scope of this invention. The above description is intended to be exemplary only, the scope of the invention being defined by the following claims and their equivalents.

What is claimed is:

1. An X-Y programmable sewing machine for attaching cloth handles to the elongated side panel of a mattress or box spring, each cloth handle being elongated in a direction generally parallel to the direction of elongation of the side panel, each handle having a length in the direction of elongation of the handle and a width in a direction generally perpendicular to the direction of elongation of the handle, the sewing machine comprising:

a sewing table for supporting a side panel;

a single sewing needle;

a rectangular clamp for holding the cloth handles in place on a side panel of a mattress or box spring disposed on said sewing table, said clamp being elongated in a direction parallel to the direction of elongation of the side panel, said clamp having two spaced side members extending generally in the direction of elongation of the side panels and two spaced transverse members extending in a direction generally transverse of the direction of elongation of the side panel, the clamp having an interior length between said two spaced transverse members generally equal to the length of the handle to be mounted and an interior width between said two spaced side members of said clamp generally equal to the width of the handle, said side and transverse members enclosing the handle within said clamp when said clamp is pressed against a side panel to assist in preventing movement of the handle with respect to said clamp and the side panel during a stitching operation;

a lip disposed on each of said side members and on each of said transverse members of said clamp, said lip extending inwardly toward a center of said clamp to overlie said sewing table and being spaced from said sewing table a distance at least equal to a thickness of the handle when said clamp is pressed against said sewing table;

means for changing a position of said clamp and said sewing needle with respect to one another in two orthogonal directions in a single plane which is generally perpendicular to a direction of movement of said sewing needle; and a controller for controlling movement of said clamp and said sewing needle with respect to one another, said controller being programmed to form a first stitch to stitch one end of the handle to a side panel at one end of the clamp, and to thereafter automatically change a position of the clamp and the needle with respect to one another in the direction of elongation of the clamp so that the needle is positioned adjacent to a second end of the clamp spaced from said one end of the clamp to form a second stitch to stitch another end of the handle to the side panel at the second end of the clamp, the first stitch being spaced sufficiently far from the second stitch to permit manual grasping of the handle therebetween.

2. The sewing machine of claim 1 further comprising a folding jig, said folding jig comprising:

a central plate having a dimension between two ends generally equal to the desired length of the handle;

an inwardly extending lip disposed adjacent to and spaced from each end of the control plate for supporting ends of material to be folded into the handle; and a space between each end of the plate and an associated lip to allow folding of handle material about the support plate.

3. A method for stitching cloth handles onto a side panel of a mattress or a box spring, said method comprising the steps of:

folding material to form an elongated handle of a desired length and width;

clamping the side panel against a table with a clamp of about the same shape as the handle;

inserting the handle into the clamp and enclosing the handle to prevent movement of the handle with respect to the side panel and the clamp during stitching of the handle to the side panel;

stitching the handle with a single sewing needle to the side panel at a first predetermined location on the handle:

automatically adjusting the position of the clamp and the needle with respect to one another to position the single sewing needle at a second predetermined location on the handle while the handle remains clamped to the side panel and without movement of the side panel or handle with respect to the clamp; and automatically stitching the handle to the side panel at the second location while the handle remains clamped to the side panel, the first location being spaced sufficiently far from the second location so that the handle may be manually grasped in the space between the first and second locations.

4. The method as recited in claim 3 wherein said stitching step, for each location where the handle is being stitched, comprises the steps of:

sewing a stitch in a square configuration, the square configuration stitch being bounded along three sides by the clamp; and sequentially sewing two diagonal stitches between opposite corners of the square configuration stitch.

5. An X-Y programmable sewing machine for attaching cloth handles to the elongated side panel of a mattress or box spring, the sewing machine comprising:

a sewing needle;

a rectangular clamp for holding cloth handle material in place on a side panel of a mattress or box spring, said clamp being elongated in a direction parallel to a direction of elongation of the side panel, the clamp having an interior length equal to a desired length of the handle to be mounted and an interior width equal to a desired width of the handle, the clamp having a first end and a second end spaced from the first end in the direction of elongation of the clamp;

means for moving the clamp with respect to the sewing needle in two orthogonal directions in a single plane which is generally perpendicular to a direction of movement of the sewing needle;

a controller for controlling movement of said clamp with respect to said sewing needle, said controller being programmed to stitch one end of the handle to a side panel at the first end of the clamp, and to thereafter automatically advance the clamp in the direction of elongation of the clamp to the second end of the clamp to stitch the other end of the handle to the side panel at the second end of the clamp; and a folding jig comprising:

a central plate having a dimension between two ends generally equal to the desired length of the handle;

an inwardly extending lip disposed adjacent to and spaced from each end of the central plate for supporting ends of the material to be folded into the handle; and a space between each end of the plate and an associated lip to allow folding of handle material about the support plate.

* * * * *